US007025395B2

(12) United States Patent
Fisher

(10) Patent No.: US 7,025,395 B2
(45) Date of Patent: Apr. 11, 2006

(54) LATCH ASSEMBLY AND STRIKER

(75) Inventor: Sidney Edward Fisher, Worcestershire (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 181 days.

(21) Appl. No.: 10/682,362

(22) Filed: Oct. 9, 2003

(65) Prior Publication Data

US 2004/0094969 A1 May 20, 2004

(30) Foreign Application Priority Data

Oct. 11, 2002 (GB) ..... 0223617

(51) Int. Cl.
*E05B 15/02* (2006.01)

(52) U.S. Cl. ..... 292/340; 292/DIG. 40; 292/341.12

(58) Field of Classification Search ..... 292/337, 292/340, DIG. 39, DIG. 40, DIG. 51, 341.12
See application file for complete search history.

(56) References Cited

U.S. PATENT DOCUMENTS 3,848,911 A * 11/1974 Watermann et al. ..... 292/216
4,165,112 A * 8/1979 Kleefeldt ..... 292/216
4,756,563 A 7/1988 Garwood et al.
4,869,023 A 9/1989 Bakula et al.
5,064,229 A * 11/1991 Hamada et al. ..... 292/216
5,069,491 A * 12/1991 Weinerman et al. ..... 292/48
5,295,720 A * 3/1994 Budde ..... 292/201
2002/0000727 A1 1/2002 Rass et al.

FOREIGN PATENT DOCUMENTS

| | | |
|---|---|---|
| DE | 3713558 | 8/1988 |
| DE | 10135030 | 2/2002 |
| EP | 0272116 | 6/1988 |
| EP | 0314075 | 5/1989 |
| GB | 300411 | 11/1928 |
| GB | 409095 | 4/1934 |

* cited by examiner

*Primary Examiner*—Gary Estremsky
(74) *Attorney, Agent, or Firm*—Carlson, Gaskey & Olds

(57) ABSTRACT

A latch bolt engages a striker to releaseably secure a first door to either a vehicle body or a second door by relative displacement of the latch towards the striker. The latch bolt moves in a first plane to releaseably retain the striker. The assembly includes a first vertical wedge arrangement and a second vertical wedge arrangement that substantially prevent movement between the latch and the striker in a direction parallel to the first plane when in a latched condition. The vertical wedge arrangements include first and second abutment surfaces on the striker arranged engage third and fourth complementary surfaces of the latch. The arrangements are provided laterally either side of a striker bar portion of the striker and laterally either side of the latch bolt.

22 Claims, 7 Drawing Sheets

FIG. 8
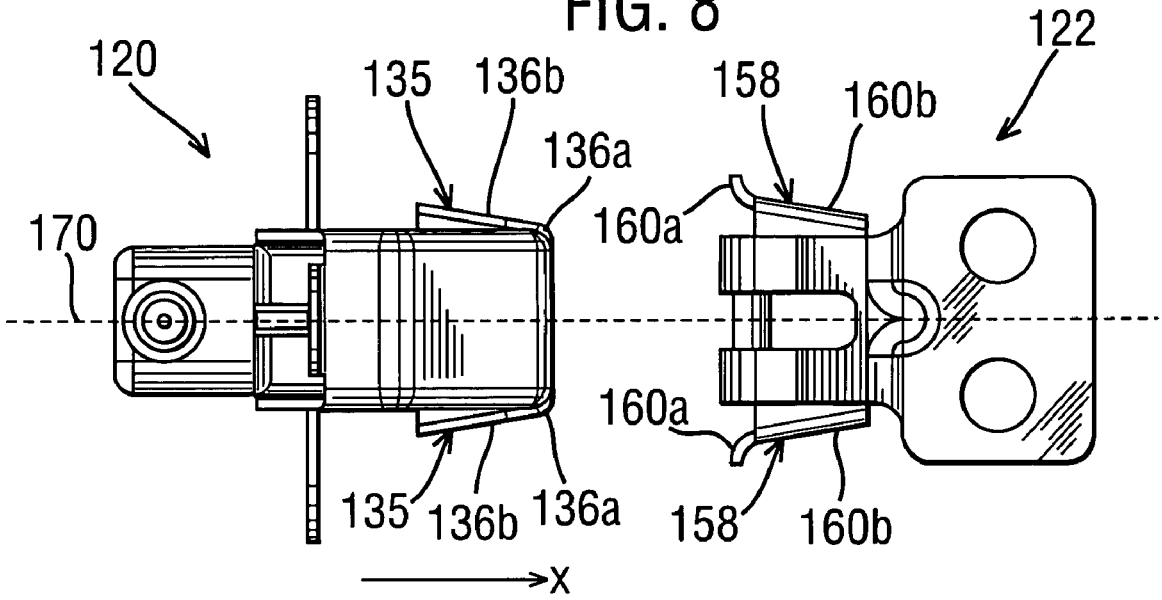
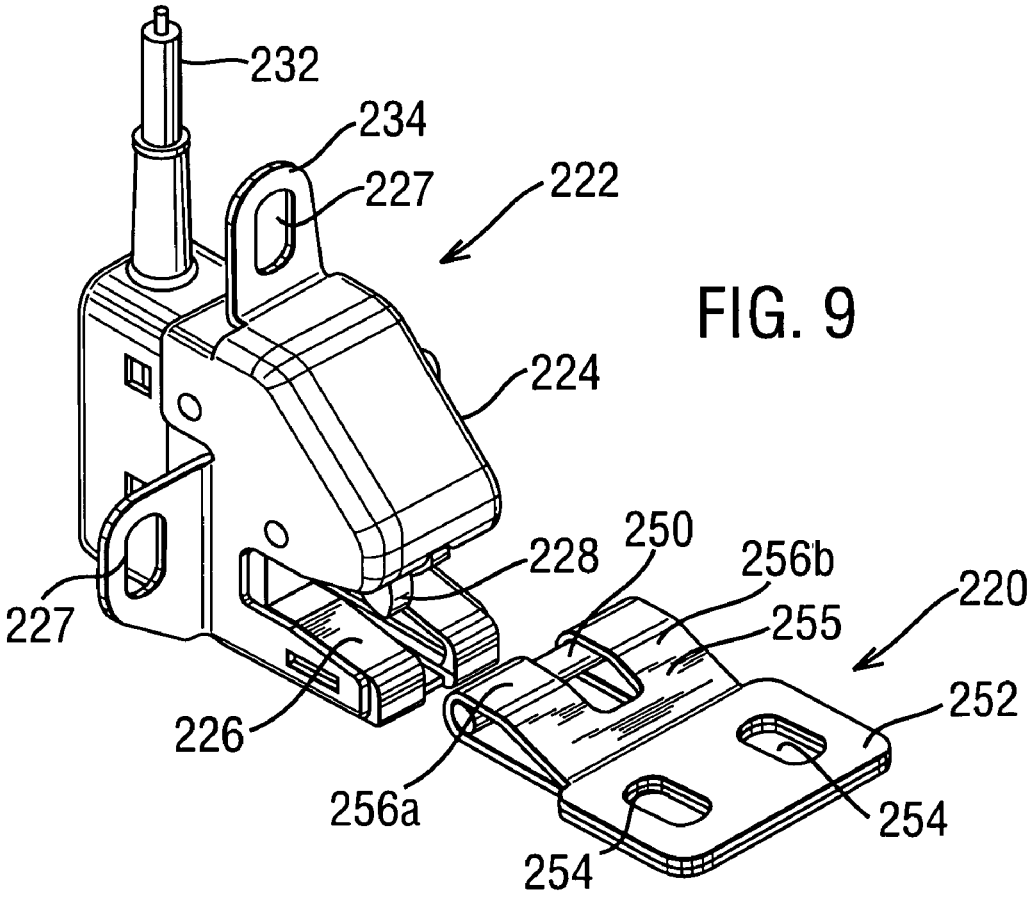
FIG. 9

LATCH ASSEMBLY AND STRIKER

REFERENCE TO RELATED APPLICATIONS

This patent application claims priority to Great Britain Patent Application No. GB 0223617.2 filed on Oct. 11, 2002.

TECHNICAL FIELD

The present invention relates generally to a latch assembly for a vehicle including a latch and a striker having a co-operating wedge arrangement.

BACKGROUND OF THE INVENTION

Light commercial vehicles, such as panel vans (vans in which the load space is enclosed), typically include a relatively large rear opening closeable by two rear doors hinged to the rear most edge of each side of the van. A latch is typically provided partially up the shut-face of one of the rear doors. The latch is arranged to latch with a complementary striker provided on the shut face of the other rear door when the doors are closed. The latch may also operate shoot bolts or supplementary latches fitted to the upper and lower edges of the door fitted with the latch where the shoot bolts or supplementary latches are arranged to engage in complementary holes or strikers in the door surround. The shoot bolts or supplementary latches provide additional latching strength to the doors when closed, resist flexing of relatively tall doors during vehicle motion, and resist any attempts to force the latched doors open.

The axes of the two hinges used to mount each door should be co-axially arranged for the hingable mounting to function. The sides of these vans often converge towards the van roof, making it necessary to mount the hinges some distance below the top of the shut-face of each door. Furthermore, a significant proportion of the structural integrity of the rear of the van load space is imparted by the closed rear doors. When the rear doors are open, the roof and side panels of the rear load space may deflect, and the doors may flex. The hinges can also wear over time. These factors may move the rear doors out of alignment, leading to difficulties in aligning the latch with the striker and/or the shoot bolts in the respective holes. This may cause problems in latching the doors.

The deflection of the roof and side panels and of the doors during vehicle motion may lead to rattling caused by play between the latch and the striker. This may increase wear on both the latch and the striker, increasing noise.

The present invention seeks to overcome, or at least mitigate, the problems of the prior art.

SUMMARY OF THE INVENTION

Either a latch or a striker of a latch assembly is mountable to a first vehicle door of a vehicle. The other of the latch or the striker is mountable to a vehicle body or to a second door of the vehicle. The latch includes a latch bolt and mouth. The latch engages the striker to releaseably secure the first door to the vehicle body or the second door by relative displacement of the latch towards the striker. The latch bolt moves in a first plane to releaseably retain the striker. The latch assembly further includes a first vertical wedge arrangement and a second vertical wedge arrangement that substantially prevents movement between the latch and the striker in a direction parallel to the first plane when in a latched condition. The vertical wedge arrangements include first and second abutment surfaces on the striker arranged to engage third and fourth complementary surfaces of a mouth portion of the latch. The vertical wedge arrangements are provided laterally on either side of a striker bar portion of the striker and laterally on either side of the latch bolt of the latch. The first and second abutment surfaces can also include mutually parallel regions.

In another embodiment, the striker includes a mounting portion, a striker bar arranged for releasable retention of the latch bolt, and first and second spaced substantially parallel planar surfaces. The first and second surfaces are arranged in the mouth of the latch and substantially prevent relative deflection perpendicular to the plane of the first and the second surfaces.

These and other features of the present invention will be best understood form the following specification and drawings.

BRIEF DESCRIPTION OF THE DRAWINGS

Embodiments of the present invention will now be described, by way of example only, with reference to the accompanying drawings in which:

FIG. 8 is a plan view of a latch assembly according to another embodiment of the present invention; and FIG. 9 is a perspective view of a latch assembly according to another embodiment of the present invention.

DETAILED DESCRIPTION OF THE PREFERRED EMBODIMENT

Figure 1A:
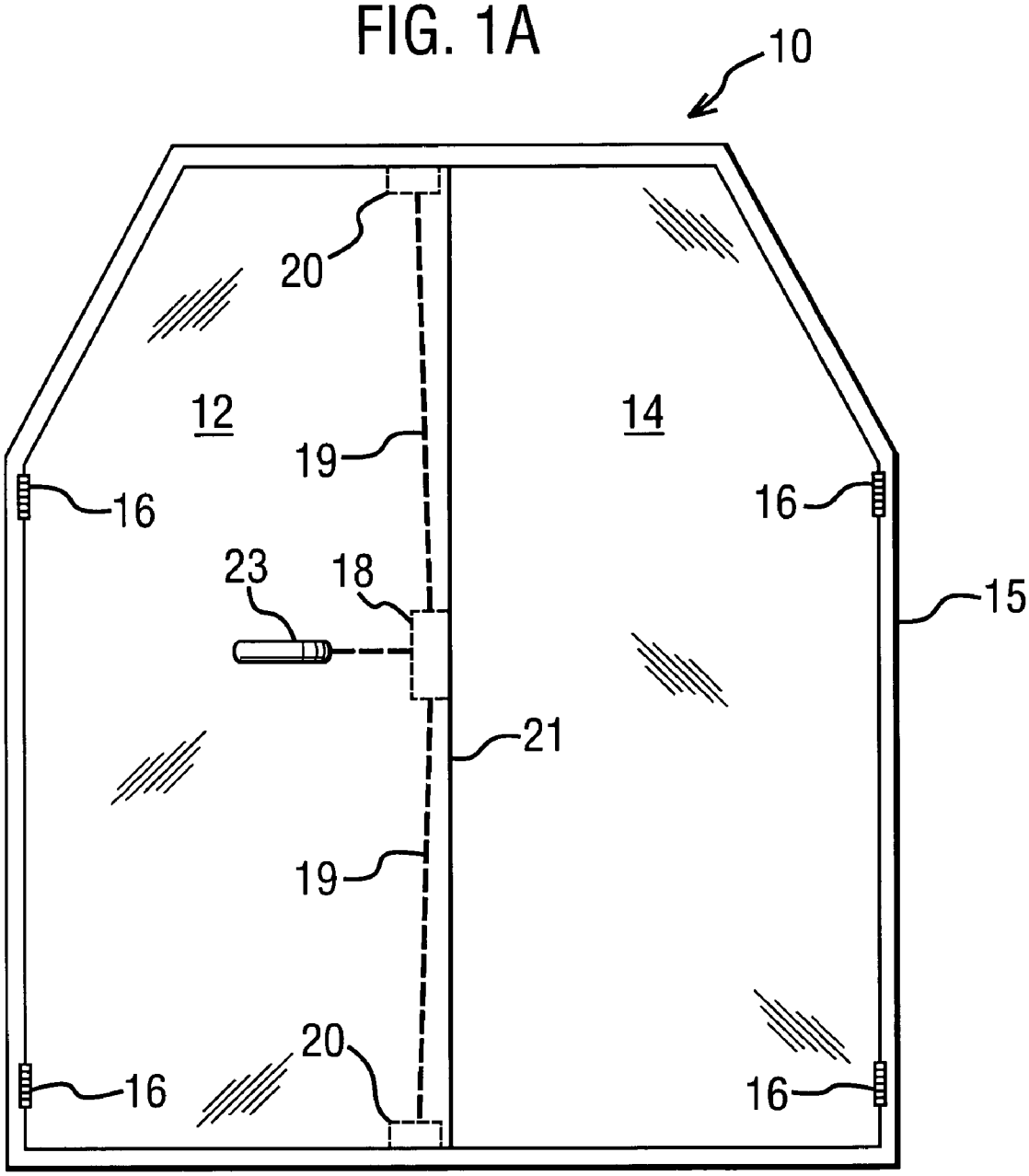
FIG. 1A is a view of the rear doors of a light commercial vehicle incorporating latches and strikers of the latch assembly of the present invention.

FIG. 1A illustrates the rear of a light commercial vehicle 10, such as a van. The rear of the van 10 includes a first rear door 12 and a second rear door 14 pivotally mounted to a door surround 15 by hinges 16. The first door 12 is opened first, followed by the second door 14, to gain full access to the vehicle load area. A primary latch 18 is mounted hear the shut-face of the first door 12 to engage and releaseably retain a complementary striker (not shown) provided on the opposed shut-face of the second door 14. The latch 18 is lockable to prevent unauthorized access to the load space of the vehicle 10.

Linkages 19, such as connecting rods or Bowden cables, extend from the top and the bottom of the latch 18 to connect the primary latch 18 with secondary latches 20 mounted near the top and bottom of the first door 12. The secondary latches 20 are positioned to engage the complementary strikers 22 (see FIG. 2) mounted to the door surround 15 of the vehicle 10. When the first door 12 is closed, it is latched to both the second door 14 and to the door surround 15, securely retaining both the doors 12 and 14 in a closed position relative to the surround 15. An outside release handle 23 can be pulled when the latch 18 is unlocked to simultaneously release both the primary latch 18 and the secondary latches 20 (by virtue of the linkages 19).

Figure 1B:
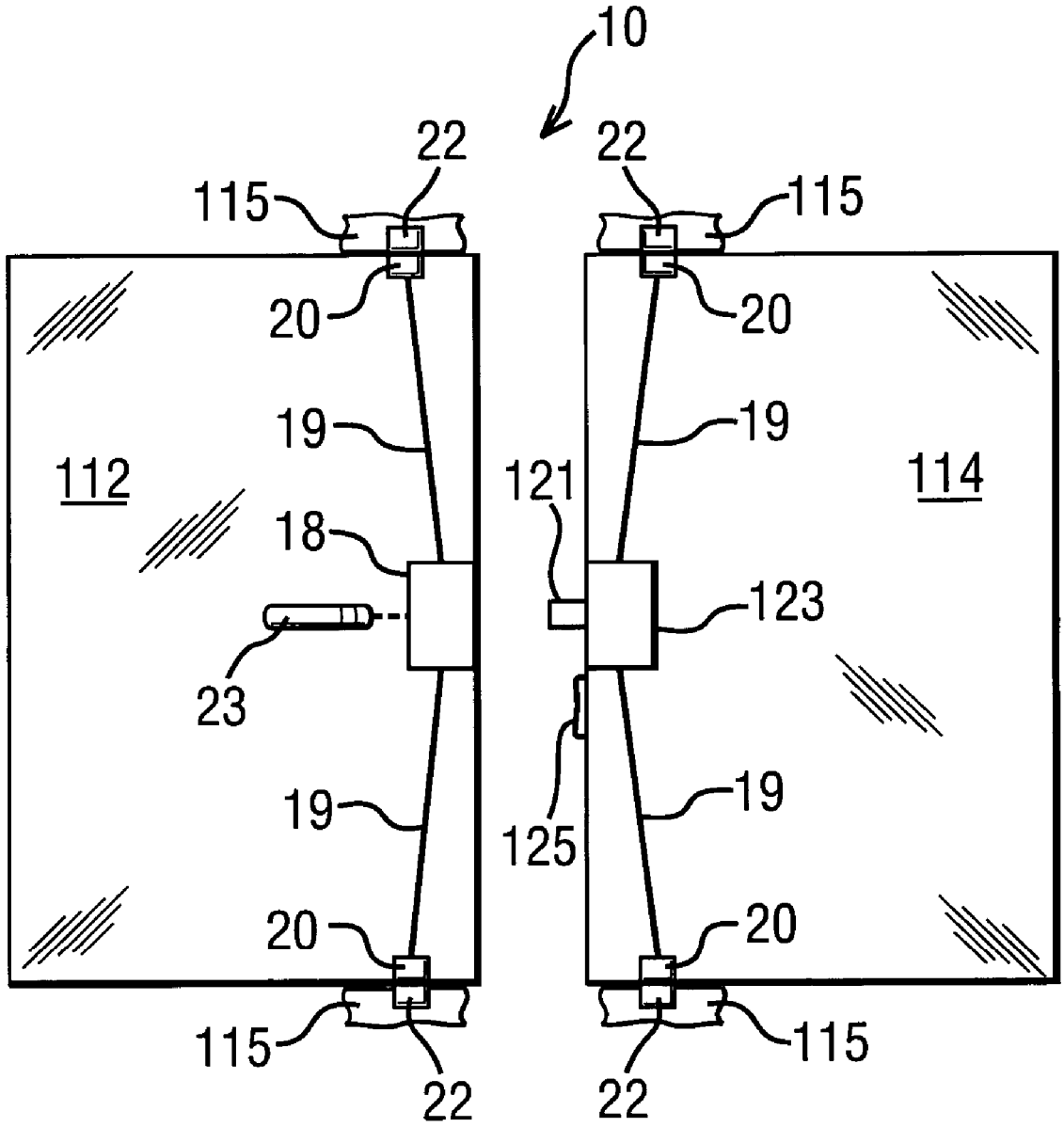
FIG. 1B is an exploded view of an alternative arrangement of latches and strikers when mounted on the rear doors of a high roof van.
Figure 1C:
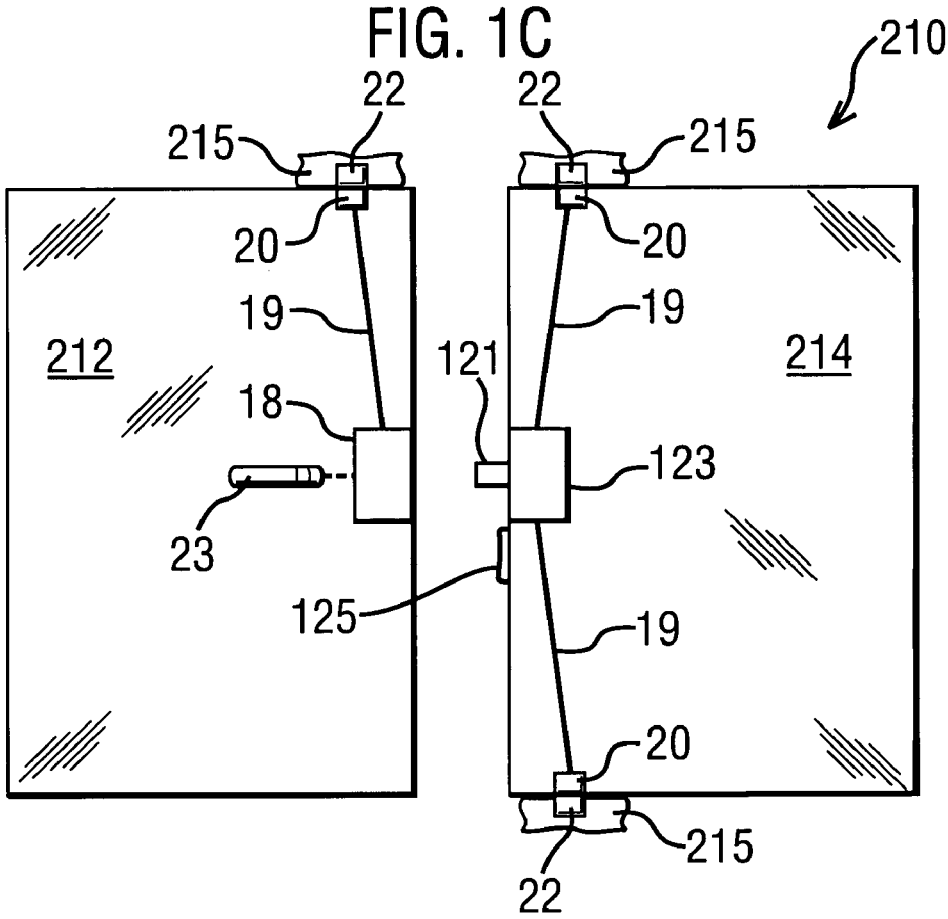
FIG. 1C is an exploded view of another alternative arrangement of latches and strikers when mounted on the rear doors of a low roof van.
Figure 1D:
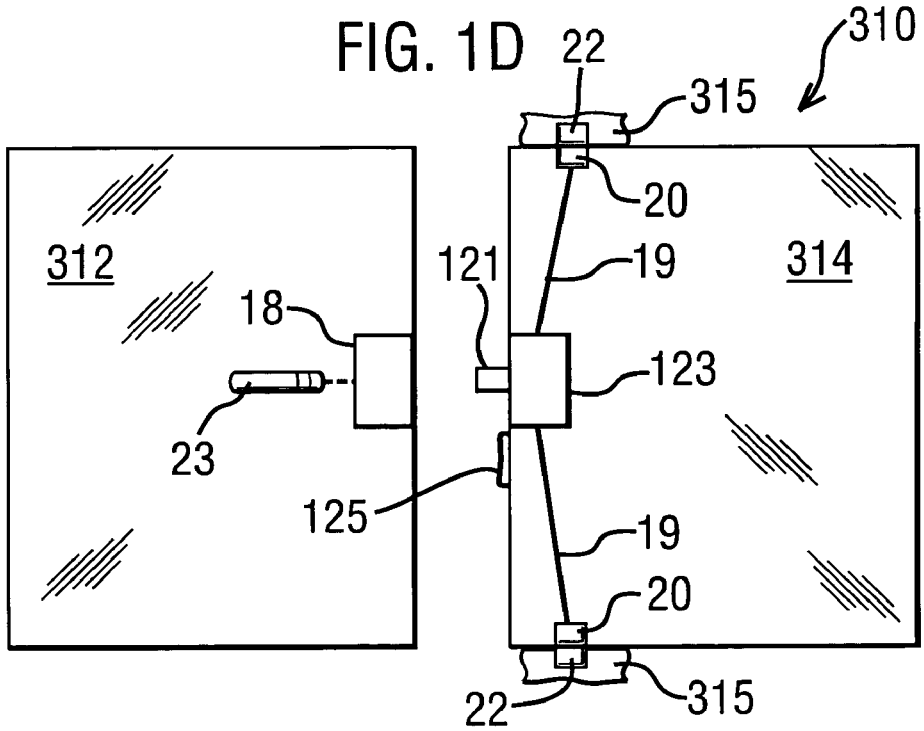
FIG. 1D is an exploded view of another alternative arrangement of latches and strikers when mounted on the rear doors of a small van.

FIGS. 1B, 1C and 1D show alternative configurations of the secondary latches 20 and the strikers 22 when fitted to a high roof line, a low roof line and a small van 110, 210, and 310, respectively. The primary latch 18 is fitted to a first door 112, 212 and 312, and a corresponding primary striker 121 is mounted to a central opening plate 123 of a second door 114, 214 and 314. A secondary release handle 125 is mounted to the shut face of the second door 114, 214, 314 and is only accessible to a vehicle user when the first door 112, 212, 312 is open. The secondary release handle 125 is operably connected to a release mechanism (not shown) within the central opening plate 123, and actuation of the secondary release handle 125 causes the latches 20 mounted on the door surround 115, 215, 315 to release from the strikers 22.

Figure 2:
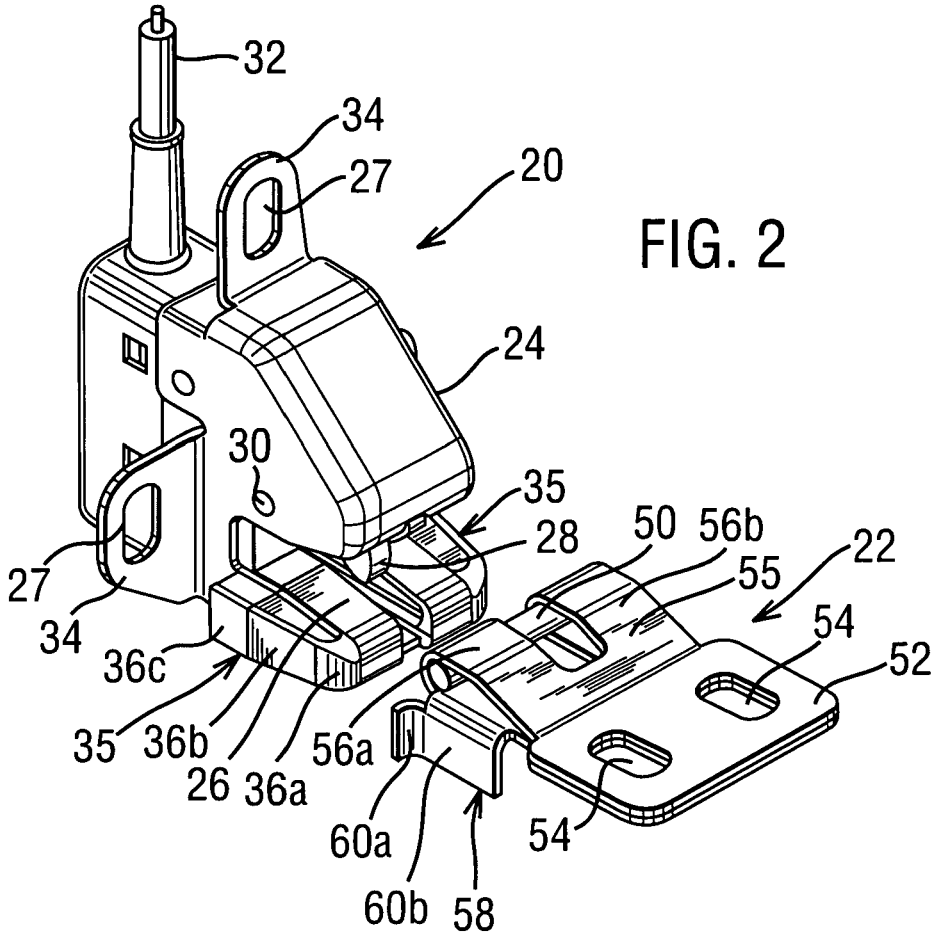
FIG. 2 is a perspective view of the latch and the striker of one embodiment of the present invention in an unlatched state.
Figure 3:
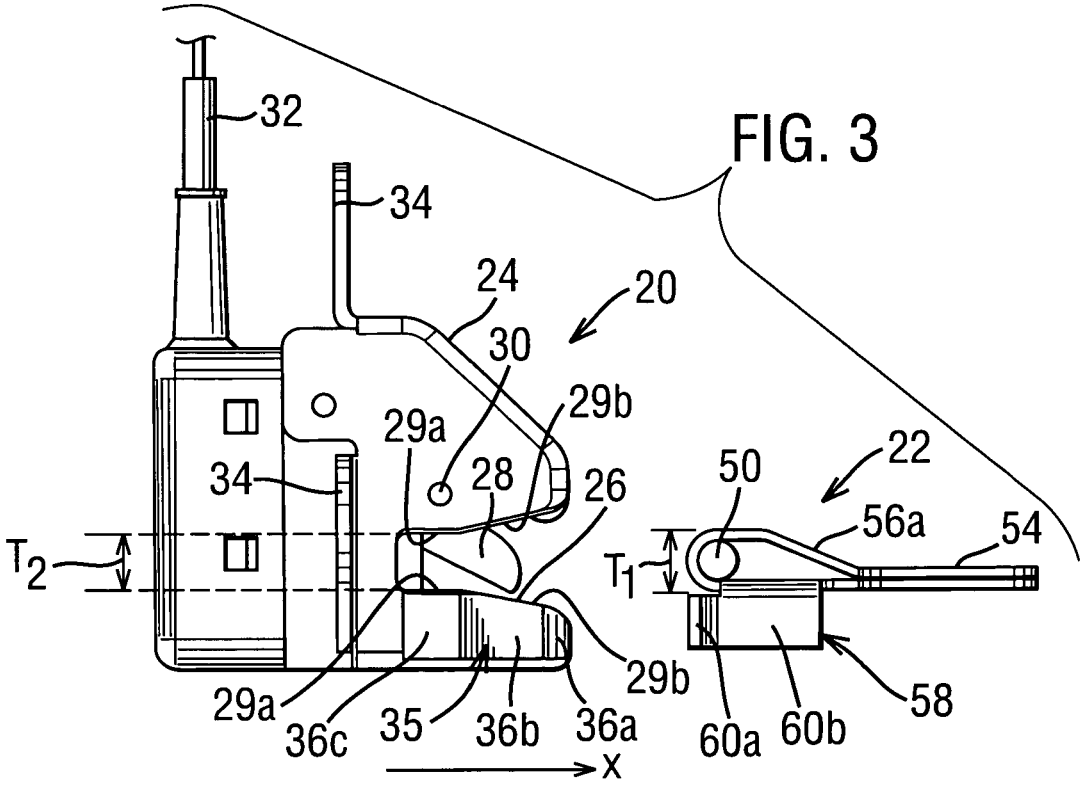
FIG. 3 is a side view of the latch and the striker of FIG. 2 in an unlatched state.
Figure 4:
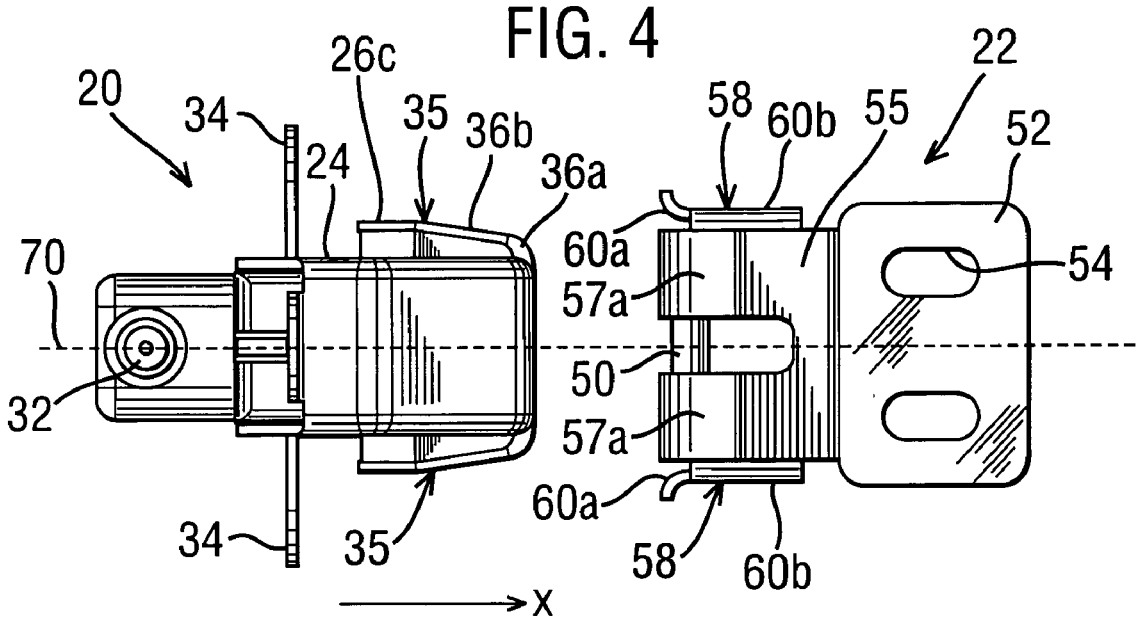
FIG. 4 is a plan view of the latch and the striker of FIG. 2 in an unlatched state.

FIGS. 2, 3 and 4 show a first embodiment of a secondary latch 20 and a striker 22 of a latch assembly in an unlatched condition. The latch 20 includes a housing 24 having a mouth 26 arranged to receive the striker 22. The housing 24 includes mounting brackets 34 having slotted apertures 27 to mount the latch to the door 12. The slotted apertures 27 allow some adjustment of the housing 34 relative to the door 12 during mounting.

A latch bolt in the form of a rotatable claw 28 is pivotally mounted within the housing 24 by a pin 30. The claw 28 is resiliently biased into the open position, as shown in FIGS. 2 and 3. A latch mechanism (not shown) connects the claw 28 to the linkage 19 from the primary latch 18, which is a Bowden cable 32 in this embodiment.

Figure 5:
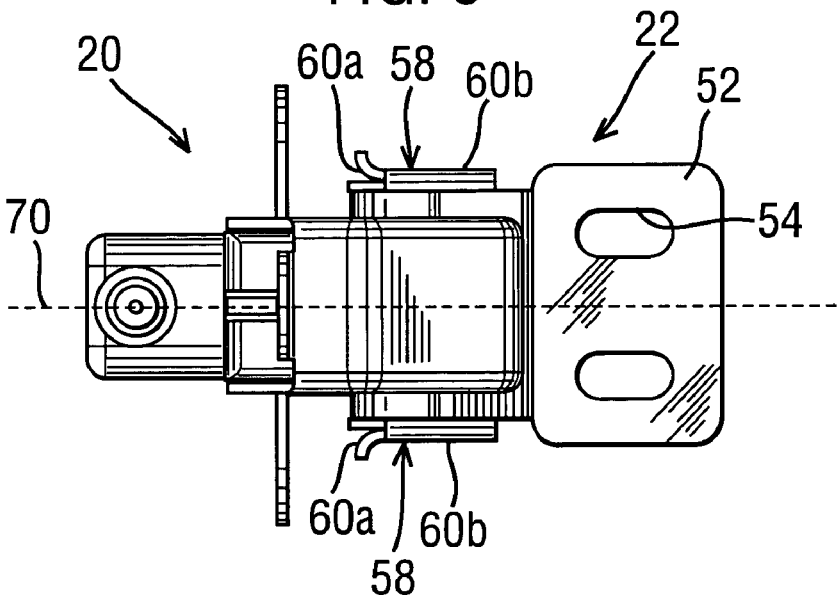
FIG. 5 is a plan view of the latch and the striker of FIG. 2 in a latched state.
Figure 6:
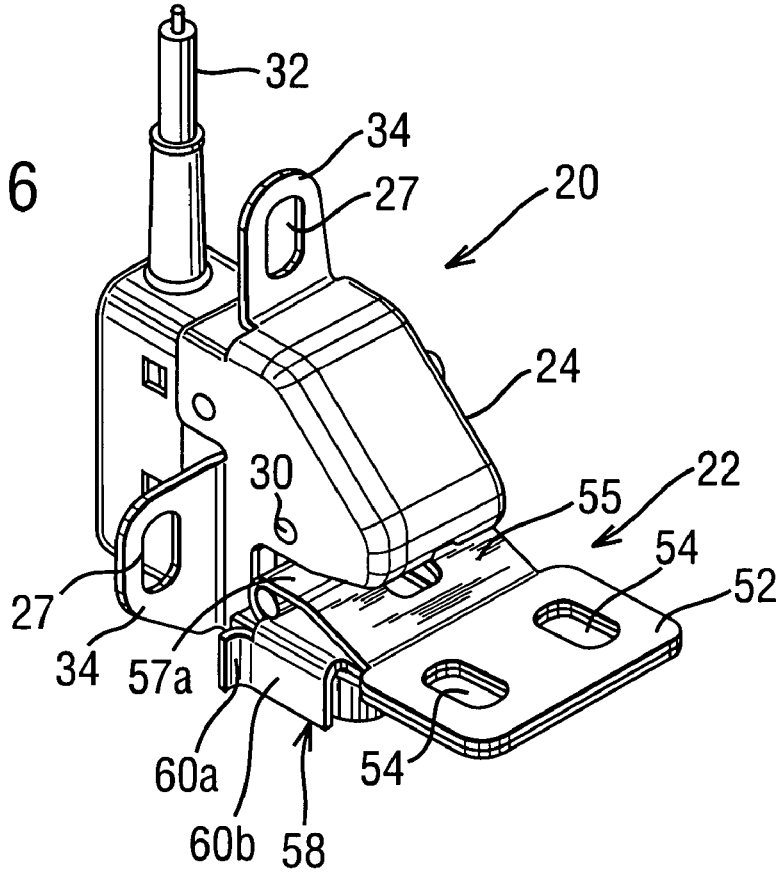
FIG. 6 is a perspective view of the latch and the striker of FIG. 2 in a latched state.
Figure 7:
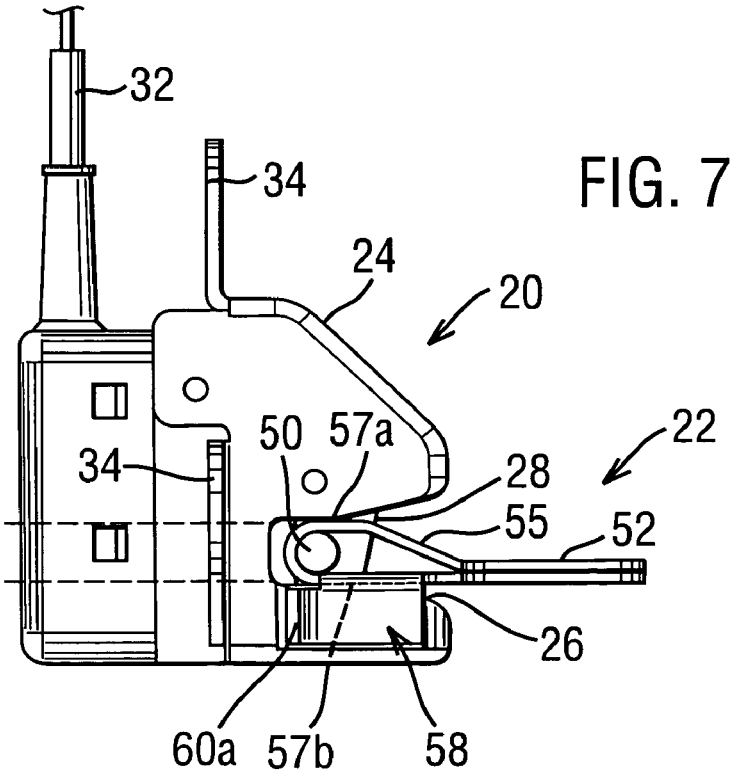
FIG. 7 is a side view of the latch and the striker of FIG. 2 when in a latched state.

As shown in FIGS. 5, 6 and 7, when the striker 22 is introduced into the mouth 26, the claw 28 rotates and is releasable retained by a pawl (not shown) of the latch mechanism, releaseably retaining the claw 28. In this embodiment, the latch 20 does not include a locking mechanism since the locking function is provided in the primary latch 18. However, a suitable known locking mechanism may be incorporated into the latch 20.

The claw 28 rotates about the pin 30 and moves in a first plane 70 from the released position shown in FIGS. 2 and 3 to the latched position shown in FIGS. 6 and 7. When the latches 20 are installed as shown in FIGS. 1A, 1B, 1C and 1D, the first plane 70 is substantially vertical and essentially parallel to the pivoting axes of the doors 12 and 14. However, it is understood that other installations are possible.

Portions of the top and the bottom of the mouth 26 (on either side of the claw 28) are preferably resilient and define first and second vertical abutment surfaces that are substantially perpendicular to the first plane. The resilience typically permits a maximum deflection of 1 mm for a 1000 N load. The surfaces include mutually parallel inner regions 29*a* and divergent outer regions 29*b*. A spacing $T_2$ is between the parallel inner regions 29*a*. Alternately, the first and second vertical abutment surfaces may be provided on only one side of the claw 28.

A first lateral wedge arrangement portion including a first lateral abutment surface 35 is provided on a side face of the housing 24 beneath the mouth 26 when oriented as shown in FIGS. 2 and 3. In this embodiment, the first lateral abutment surface 35 includes three distinct regions. From the front to the rear of the latch (from the opening of mouth 26 in a direction towards mounting brackets 34), the first lateral abutment surface 35 includes a first chamfered region 36*a*, a second region 36*b* divergent from the first plane 70 and a third region 36*c* substantially parallel to the first plane 70. In this embodiment, a second lateral abutment surface 35 is provided on the opposite side face of the housing 24 and is a mirror image of the first lateral abutment surface 35. The lateral abutment surfaces 35 are preferably resiliently deformable. In one example, the resilience is such that a 500 N loading transverse to the first plane 70 causes a deflection of less than 0.5 mm.

The resilience may be provided by employing a first lateral wedge arrangement portion of substantially non-compressible plastic material having a live hinge at its connection to the front of the latch. A small spacing between the portion and the latch housing provides a predetermined amount of resilience.

The striker 22 includes a striker bar 50 sized to engage with the claw 28. The striker 22 further includes a shaped sheet portion that holds the striker bar 50 at each end and having an appropriate formation to mount the striker 22 to the door surround 15. The shape of the sheet portion is stamped or cut from a blank to form the striker 22. The blank is then folded to retain the striker bar 50 and to form a striker bar supporting region 55 and a double thickness mounting region 52. The striker bar 50 is welded or otherwise secured to the sheet portion. The mounting region 52 is provided with slotted apertures 54 that enable the striker 22 to be screwed or bolted to the door surround 15 with some degree of adjustability, enabling the striker 22 to be correctly aligned with the latch 20.

The supporting region 55 includes legs 56*a* and 56*b* that hold and support both ends of the striker bar 50 and define a gap of size sufficient that enables the striker bar 50 to engage the claw 28. The legs 56*a* and 56*b* preferably include third and fourth vertical abutment surfaces having parallel planar regions 57*a* and 57*b* above and below the striker bar 50. The parallel planar regions 57*a* and 57*b* are provided laterally on both sides of the striker bar 50. The spacing $T_1$ between the regions 57*a* and 57*b* is substantially equal to or slightly larger than the spacing $T_2$ between the regions 29*a* and 29*b*. Together, the third and fourth vertical abutment surfaces of the legs 56*a* and 56*b* and the mouth 26 define a vertical wedge arrangement.

A second lateral wedge arrangement portion including a third lateral abutment surface 58 is formed from an integral downwardly folded portion of the leg 56*a*. The third lateral abutment surface 58 includes two distinct regions. From the front of the striker 22 (the end nearest the striker bar 50), the third lateral abutment surface 58 include, a guide member in the form of an outwardly curved mouth region 60*a* and a planar region 60*b* substantially parallel to the first plane 70 when the striker 22 is retained by the latch 20. In this embodiment, a fourth lateral abutment surface 58 is provided by a downwardly turned portion of the other leg 56*b*, the fourth lateral abutment surface 58 being a mirror image of the third lateral abutment surface 58.

When the door including the latch 20 mounted in a direction X is closed, any misalignment between the latch 20 and the striker 22, up to a predetermined limit in a lateral direction, is overcome by engagement of one of the chamfered regions 36*a* of the first or the second lateral abutment surfaces 35 with the corresponding curved region 60*a* of the third or the fourth lateral abutment surfaces 58, correctly guiding the latch 20 into horizontal alignment with the striker 22 and permitting engagement. Engagement of the front curved region of the legs 56*a* and 56*b* with the enlarged opening of the mouth 26 overcomes vertical misalignment up to a predetermined limit, bringing the latch 20 into correct vertical alignment with respect to the striker 22.

As closure continues, the claw 28 contacts the striker bar 50 to rotate the claw 28 and releaseably retain the striker 22 in the fully latched condition shown in FIGS. 5, 6 and 7. If there is insufficient relative movement to bring the latch to a fully latched condition, the pawl can retain the claw 28 in a first safety position (not shown),c which would also retain the latch 20 on the striker 22.

As the claw 28 rotates, the planar regions 60*b* of the third and the fourth lateral abutment surfaces 58 are guided by the divergent regions 36*b* of the first and the second lateral abutment surfaces 35, progressively overcoming the resilience of the abutment surfaces 35 to rest on the parallel regions 36*c*. A certain amount of compressive force is exerted between the first and the second lateral abutment surfaces 35 and the regions 60*b* of the third and the fourth lateral abutment surfaces 58 when in this position. The compressive force minimizes any possible horizontal movement at the latch 20 and the striker 22 when latched. Furthermore, the spacing $T_1$ of the striker 22 relative to the spacing $T_2$ of the mouth 26 minimizes any potential relative vertical movement between the striker 22 and the latch 20 since the top and/or the bottom resilient portions of the mouth 26 are preferably forced into compression.

The above described arrangement minimizes or substantially prevents relative movement between the latch 20 and the striker 22 in both the vertical and the lateral directions while also enabling successful latching to occur despite a degree of misalignment between the positions of the latch 20 and the striker 22 during door closure.

FIG. 8 shows the latch 120 and the striker 122 having an alternate lateral wedge arrangement according to a second embodiment of the present invention. The regions 160*b* of the third and fourth lateral abutment surfaces 158 diverge from the first plane 170. The first and the second lateral abutment surfaces 135 do not include a region parallel with the first plane 170. Therefore, as the latch 120 engages the striker 122, additional movement of the latch in the closure direction X causes additional compressive forces to be exerted between the first lateral wedge arrangement portion and second lateral wedge arrangement portion. In the first embodiment, a maximum compressive force is reached as the region 60*b* rests on the region 36*c*.

FIG. 9 illustrates a striker 222 according to a third embodiment of the present invention. Like parts have been denoted by like numerals with the addition of the prefix "2" and the lateral wedge arrangement has been omitted all together. This embodiment of the striker may be used in applications that do not require lateral wedging or when the wedging in this direction is provided elsewhere on the door and the surround.

It should be appreciated that the terms used to describe the orientation of the various latch 20 and striker 22 components in the description have been used for ease of understanding and should not be regarded as limiting. The latch 20 and striker 22 of the present invention may be orientated in any direction as required by the latching of one to the other.

It will be appreciated that numerous changes may be made within the scope of the present invention. For example, some applications may require only first and second lateral wedge arrangement portions 35 having one abutment surface each. Additionally, it will be appreciated that the second lateral wedge arrangement portion 58 may be provided on the latch 20 and the first lateral wedge arrangement portion 35 on the striker 22. The construction of both the striker 22 and latch 20 may be altered. Furthermore, the invention may be applied to other types of latch 20 which do not operate using a rotatable claw type latch bolt. The lateral wedge arrangement portion may be provided above, rather than below, the mouth 26.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch assembly comprising:

a latch including a recessed mouth to receive a striker bar and a latch bolt moveable in a first plane to cooperate with the recessed mouth and releaseably retain the striker bar, wherein the recessed mouth includes a first wedge arrangement having an inwardly facing first abutment surface and an inwardly facing second abutment surface, the first wedge arrangement being provided laterally of, and on both sides of, the latch bolt, the inwardly facing first abutment surface and the inwardly facing second abutment surface being substantially perpendicular to the first plane, and the latch is mountable to a first vehicle structure; and a striker including, the striker bar, the striker bar having a striker bar axis, a first striker bar end region, a second striker bar end region and a second wedge arrangement having a third abutment surface and a fourth abutment surface, wherein the second wedge arrangement is provided longitudinally with respect to the striker bar axis at the first striker bar end region and the second striker bar end region and the striker is mountable to a second vehicle structure, wherein engagement of the latch bolt and the striker releasably secures the first vehicle structure to the second vehicle structure by relative displacement of the latch towards the striker such that the striker bar axis extends perpendicular to the first plane when the striker bar is releasably retained by the latch bolt, and wherein the first wedge arrangement and the second wedge arrangement prevent movement between the latch and the striker in a direction substantially parallel to the first plane when the latch assembly is in a latched condition and the inwardly facing first abutment surface and the inwardly facing second abutment surface engage the third abutment surface and the fourth abutment surface, respectively.

2. The assembly according to claim 1 wherein the third abutment surface and the fourth abutment surface include a guide arrangement to assist the latch in engagement with the striker during relative displacement of the latch towards the striker.

3. The assembly according to claim 1 wherein the inwardly facing first abutment surface includes a first region and the inwardly facing second abutment surface includes a second region substantially parallel to the first region.

4. The assembly according to claim 1 wherein at least one of the third abutment surface and the fourth abutment surface includes a substantially planar region.

5. The assembly according to claim 1 wherein the third abutment surface and the fourth abutment surface are directly adjacent to the striker bar.

6. The assembly according to claim 5 wherein the striker includes a first arm and a second arm that retain the first striker bar end region and the second striker bar end region, respectively, and the first arm and the second arm extend transverse to the striker bar axis.

7. The assembly according to claim 6 wherein the third abutment surface and the fourth abutment surface are provided on at least one of the first arm and the second arm.

8. The assembly according to claim 7 wherein at least one of the first arm and the second arm is a metal plate that at least partially encircles the striker bar and provides the third abutment surface and the fourth abutment surface.

9. The assembly according to claim 6 wherein the first arm and the second arm are integral with a structure that mounts the striker to the first vehicle component.

10. The assembly according to claim 1 wherein the inwardly facing first abutment surface and the inwardly facing second abutment surface are resilient.

11. The assembly according to claim 1 wherein the inwardly facing first abutment surface includes a first region and the inwardly facing second abutment surface includes a second region substantially parallel to the first region, and wherein the first region and the second region are separated by a striker spacing.

12. The assembly according to claim 11 wherein the third abutment surface includes a third region and the fourth abutment surface includes a fourth region substantially parallel to the third region, the third region and the fourth region are separated by a latch spacing, and the striker spacing is less than the latch spacing.

13. The assembly according to claim 1 wherein the third abutment surface includes a third region and the fourth abutment surface includes a fourth region substantially parallel to the third region.

14. The assembly according to claim 1 wherein the third abutment surface and the fourth abutment surface contact the first striker bar end region and the second striker bar end region, respectively.

15. The assembly according to claim 1 further including a gap between the third abutment surface and the fourth abutment surface, wherein the striker is received in the gap when the latch assembly is in the latched condition.

16. A latch assembly comprising:

a latch including a recessed mouth to receive a striker bar and a latch bolt moveable in a first plane to cooperate with the recessed mouth and releasably retain the striker bar, wherein the recessed mouth includes an inwardly facing first abutment surface having a first region and a second abutment surface having a second region substantially parallel to the first region, wherein the latch is mountable to a first vehicle component;

a striker including the striker bar having a striker bar axis, a third abutment surface and a fourth abutment surface, wherein the striker is mountable to a second vehicle component and engagement of the latch bolt and the striker releasably secures the first vehicle component to the second vehicle component by relative displacement of the latch towards the striker such that the striker bar axis extends substantially perpendicular to the first plane when the striker bar is releasably retained by the latch bolt; and a vertical wedge arrangement to prevent movement between the latch and the striker in a direction substantially parallel to the first plane when the latch assembly is in a latched condition, wherein the vertical wedge arrangement is provided laterally of, and on both sides of, the latch bolt and the inwardly facing first abutment surface and the second abutment surface are substantially perpendicular to the first plane and engage the third abutment surface and the fourth abutment surface, respectively.

17. The assembly according to claim 16 wherein the third abutment surface and the fourth abutment surface include a guide arrangement to assist the latch in engagement with the striker during relative displacement of the latch towards the striker.

18. The assembly according to claim 16 wherein at least one of the third abutment surface and the fourth abutment surface include a substantially planar region.

19. The assembly according to claim 16 wherein the inwardly facing first abutment surface and the second abutment surface are resilient.

20. The assembly according to claim 16 wherein the first region and the second region are separated by a striker spacing.

21. The assembly according to claim 20 wherein the third abutment surface includes a third region and the fourth abutment surface includes a fourth region separated by a latch spacing, and the striker spacing is less than the latch spacing.

22. A striker for releasable securement to a latch, the striker comprising:

a mounting portion;

a striker bar to be releasably retained by a latch bolt of the latch, the striker bar including a striker bar axis, a first striker bar end region and a second striker bar end region; and a first arm and a second arm that retain the first striker bar end region and the second striker bar end region and connect the striker bar to the mounting portion, wherein the first arm and the second arm extend transverse to the striker bar axis and at least one of the first arm and the second arm is a metal plate that at least partially encircles the striker bar and provides a first planar surface and a second planar surface arranged to engage a recessed mouth of the latch and to substantially prevent relative deflection transverse to the striker bar axis.

* * * * *